US005087128A

United States Patent [19]

Matthews et al.

[11] Patent Number: 5,087,128

[45] Date of Patent: Feb. 11, 1992

[54] METHOD AND APPARATUS FOR INTEGRATING NUTRITIONAL SUPPLEMENTS FOR SUBSEQUENT MIXING WITH LIVESTOCK FEED GRAIN

[75] Inventors: James S. Matthews, Circleville; Robert K. Matthews, Canton, both of Ohio; Myron M. Martin, Lebanon, Pa.

[73] Assignee: Robert J. Matthews Co., Canton, Ohio

[21] Appl. No.: 505,574

[22] Filed: Apr. 6, 1990

[51] Int. Cl.[5] ..... B01F 15/04

[52] U.S. Cl. ..... 366/141; 366/341; 366/9; 366/336; 366/14; 366/603; 366/173; 366/187; 366/233; 366/227; 414/294

[58] Field of Search ..... 366/141, 603, 836, 337, 366/18, 9, 14, 177, 228, 156, 338, 182, 341, 173, 233, 227, 220; 414/294, 299

[56] References Cited

U.S. PATENT DOCUMENTS

| | | | |
|---|---|---|---|
| 2,255,468 | 9/1941 | Kemp | 366/336 |
| 2,530,501 | 11/1950 | Avril | 366/141 |
| 4,204,773 | 5/1980 | Bates | 366/18 |
| 4,459,028 | 7/1984 | Bruder et al. | 366/156 |
| 4,498,783 | 2/1985 | Rudolph | 366/141 |
| 4,667,503 | 5/1987 | Loos | 366/141 |

*Primary Examiner*—Philip R. Coe
*Assistant Examiner*—Reginald L. Alexander
*Attorney, Agent, or Firm*—Michael Sand Co.

[57] ABSTRACT

A method and apparatus for automatically and simultaneously weighing and integrating various nutritional supplements for subsequent blending with livestock feed grain. The apparatus includes a housing formed with a plurality of upper inlet openings and a lower outlet opening. A plurality of augers convey nutritional supplements from a storage area into the inlet openings. A plurality of weigh hoppers are pivotally mounted below the inlet openings on load cells. Weight indicators are electrically connected to the load cells and augers, and are interfaced with a computer, for controlling and coordinating the deposit of supplements from the augers, load cell weighing, and the pivotal dumping movement of the weigh hoppers. A funnel containing a plurality of deflectors is mounted within the housing below the weigh hoppers, and communicates at its lower end with a motor-driven flighted drum rotatably mounted within the housing, which in turn communicates with the outlet opening. The method of the invention includes the step of automatically and simultaneously metering the supplements into the weigh hoppers through the augers. The supplements then are automatically and simultaneously weighed and dumped into the funnel. The supplements travel downwardly by gravity through the funnel and deflectors which combine to integrate and guide the supplements into the rotating drum. The drum further integrates the supplements and urges the supplements from the drum and out of the outlet opening into packages for transport to a feed manufacturer. The feed manufacturer then blends the integrated supplements with feed in a batch blending apparatus.

18 Claims, 5 Drawing Sheets

METHOD AND APPARATUS FOR INTEGRATING NUTRITIONAL SUPPLEMENTS FOR SUBSEQUENT MIXING WITH LIVESTOCK FEED GRAIN

BACKGROUND OF THE INVENTION

1. Technical Field

The invention relates to methods and apparatus for integrating various nutritional supplements, and in particular to methods and apparatus for precisely weighing and integrating the supplements for packaging, shipment and subsequent blending with livestock feed grain in a batch blending apparatus by a feed manufacturer.

2. Background Information

As is the case with most other sciences and arts, agriculture is becoming increasingly sophisticated. The typical farmer must be knowledgeable in many technical matters in order to run a profitable business. One such technical matter relates to the need for supplementing the diet of his/her livestock with various vitamins and minerals, such as salt, calcium, phosphorus, etc., to produce larger and healthier animals.

The method currently employed for incorporating dietary supplements into livestock feed grain begins with the step of the manufacturer of the vitamin and mineral supplements typically mixing a given formulation of the vitamins and minerals in a large batch of approximately four tons. More particularly, the multiple components of a particular vitamin and mineral composition are individually measured and then placed in a large drum having flights or other means therein for mixing the vitamins and minerals. The drum then is rotated for several minutes to thoroughly mix the supplements, afterwhich the drum is stopped and the composition contained therein is packaged in individual, usually 50 pound bags. It is to be understood that the terms "mix" and "blend", as used herein, connote a more thorough combining of elements than does the term "integrate". More particularly, as used herein, the terms mix and blend mean to combine into a generally uniform whole, while integrate means to combine, but not necessarily to the degree whereby uniformity is achieved. This resulting "pre-mix" of vitamins and minerals then is shipped either to a farm having its own mixing facility or to a feed plant having a mixing facility. An appropriate number of bags of the vitamin and mineral pre-mix then is added to approximately one ton of livestock feed, which may comprise several different grains such as corn and beans. The feed and pre-mix then are thoroughly blended or mixed in any suitable batch blending apparatus which includes vertical and horizontal-type blenders. The resulting nutritionally supplemented feed grain then is placed in the livestock feeders.

Although the above-described method is satisfactory for producing a well-mixed livestock feed containing various grain meals and vitamins and minerals, a certain duplication of effort is inherent in this method. Such duplication of effort is economically inefficient and wasteful, which is unacceptable especially in view of the precarious economic situation which many farmers find themselves in today. More specifically, pre-mixing of the vitamins and minerals is an unnecessary step toward delivering satisfactory nutritional supplements to farmers and feed manufacturing plants. That is, since farmers and feed manufacturing plants will ultimately mix the nutritional supplements with the feed grains anyway, the step of pre-mixing the vitamins and minerals is unnecessary.

In addition, the practice of pre-mixing nutritional supplements in batch form is inefficient due to the fact that workers stand idle during the time that the large drum containing a four ton batch of a supplement formulation is mixing. Only when the contents of the conventional batch mixer have been completely discharged and recharged by way of manual and mechanical inputs may the mixing process resume. Moreover, the power required to rotate a drum containing four tons of vitamins and minerals is substantial and costly. Also, the type of mixing equipment needed to blend such large batches of supplements does not lend itself well to mixing "special request" supplement formulations and the like in small batches, so that such formulations must be prepared separately at increased cost to the purchaser. Finally, finished inventory costs are increased since conventional batch mixing techniques are applied efficiently only to full mixer load batches. This results in residual inventories of certain formulations for sometimes extended periods in anticipation of future need.

Although the uniform appearance of the pre-mixed nutritional supplements may be pleasing to the end user thereof, it is much more important to produce a supplement formulation in which the various vitamins and minerals are precisely weighed and proportioned. Although the 4 ton batch of a given supplement formulation may be precisely weighed and proportioned when the vitamins and minerals are placed in the mixing drum, many of the individual packages of the supplement formulation will have vitamin and mineral proportions which differ in varying degrees from the intended batch proportion. This is because it is impossible to mix such a large batch so that each portion thereof contains exactly the same proportion of vitamins and minerals.

There is no known prior art method and apparatus for integrating various vitamin and mineral supplements, in which the method and apparatus provide for precisely weighing and integrating exactly the same proportion of vitamins and minerals into each package of a particular supplement formulation, for subsequent blending with livestock feed grain in a batch blending apparatus by a feed manufacturer.

SUMMARY OF THE INVENTION

Objectives of the present invention include providing a method and apparatus for integrating nutritional supplements for subsequent mixing with livestock feed grain in which the various vitamins and minerals of a particular supplement formulation are precisely weighed, integrated and packaged, so that each package contains exactly the same proportion of the vitamins and minerals.

Another objective of the invention is to provide such a method and apparatus for integrating nutritional supplements in which vitamin and mineral supplement formulations are prepared a package at a time, and in which a large number of packages can be produced in a short time period.

A further objective of the invention is to provide such a method and apparatus for integrating nutritional supplements in which the vitamin and mineral supplements are rapidly and continuously weighed, integrated and packaged.

Still another objective of the invention is to provide such a method and apparatus for integrating nutritional supplements in which the supplements are integrated without an excessive expenditure of power or a large number of mechanical moving parts.

A still further objective of the invention is to provide such a method and apparatus for integrating nutritional supplements in which the inventory of finished goods representing various specific formulations is reduced relative to the inventory required for prior methods.

Another objective of the invention is to provide such a method and apparatus for integrating nutritional supplements in which customized supplement formulations can be produced relatively inexpensively.

A further objective of the invention is to provide such a method and apparatus for integrating nutritional supplements in which the supplement formulations can be produced in a relatively dust-free environment.

A still further objective of the invention is to provide such a method and apparatus for integrating nutritional supplements which reduces the manufactured cost of vitamin and mineral nutritional supplements over those produced by prior methods and apparatus.

Still another objective of the invention is to provide such a method and apparatus for integrating nutritional supplements which is more efficient and less expensive than prior apparatus and methods for manufacturing vitamin and mineral supplement formulations.

A still further objective of the invention is to provide such a method and apparatus of integrating nutritional supplements in which the apparatus is relatively inexpensive, compact, durable and easy to operate and maintain, and in which the method is effective, efficient, inexpensive, and requires a minimal number of workers to carry out.

These objectives and advantages are obtained by the method of the present invention for integrating various nutritional supplements and subsequently blending the integrated supplements with a livestock feed grain, the general nature of which may be stated as including the steps of automatically and simultaneously weighing each of the various nutritional supplements, gravitationally integrating the weighed supplements, and blending the integrated nutritional supplements with the livestock feed grain in a batch blending apparatus.

These objectives and advantages are further obtained by the apparatus of the present invention adapted for automatically and simultaneously weighing and integrating at least two different nutritional supplements for subsequent blending with a livestock feed grain, the general nature of which may be stated as including a housing formed with at least one inlet opening and an outlet opening below said inlet opening; weighing means mounted within the housing adjacent to the housing inlet opening for receiving, weighing, and releasing the nutritional supplements; metering means for depositing the nutritional supplements into the weighing means through the inlet opening of the housing; means mounted within the housing below the weighing means for integrating and guiding the weighed and released supplements downwardly and out of the housing outlet opening; and computer means interfaced with the weighing means and metering means for controlling and coordinating the receipt, weighing and release of the nutritional supplements.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
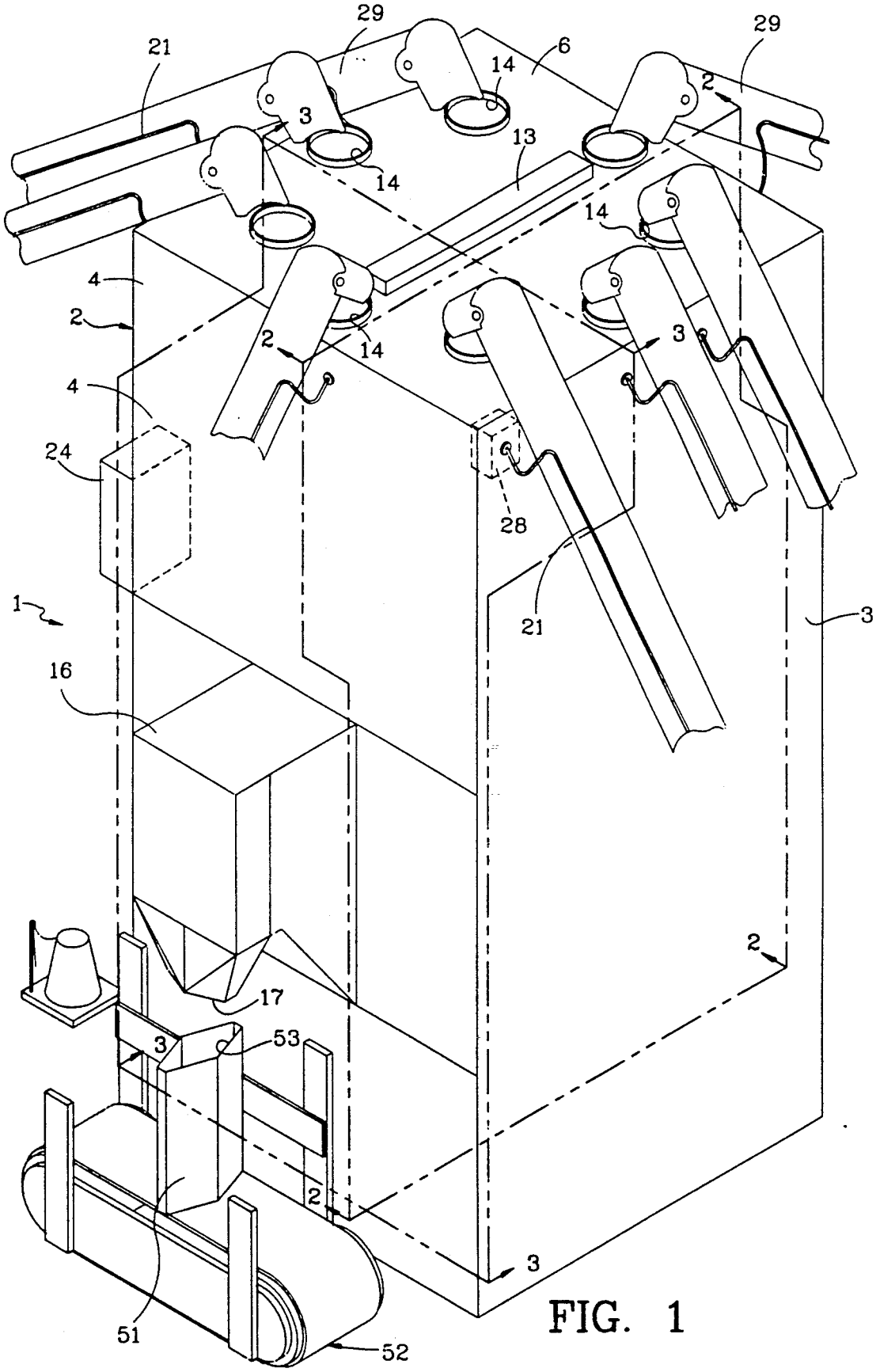
FIG. 1 is a fragmentary perspective view of the weighing and integrating apparatus of the present invention, shown in its intended use with auxiliary metering and packaging equipment.
Figure 2:
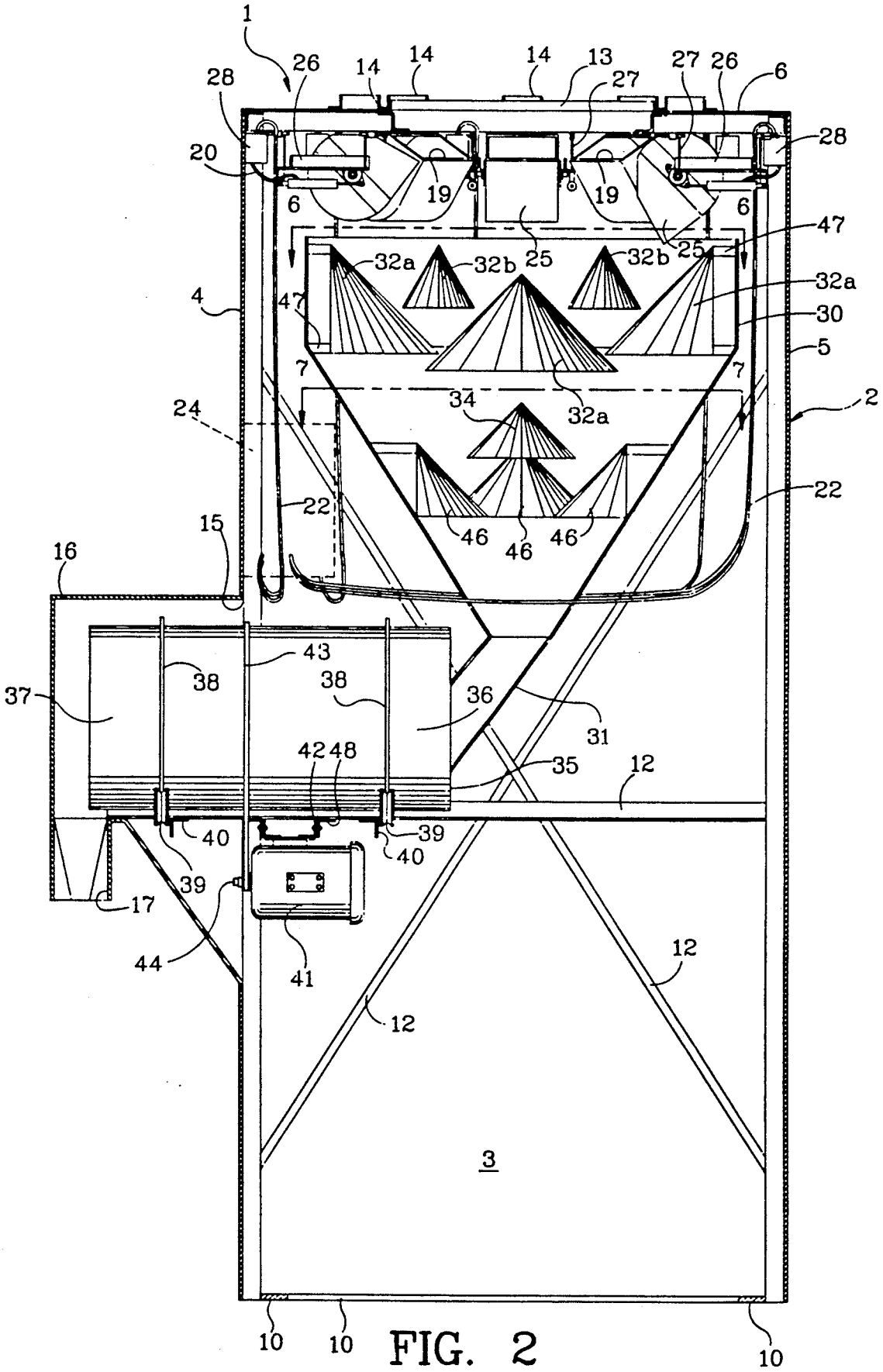
FIG. 2 is an enlarged sectional view taken on line 2—2, FIG. 1.
Figure 3:
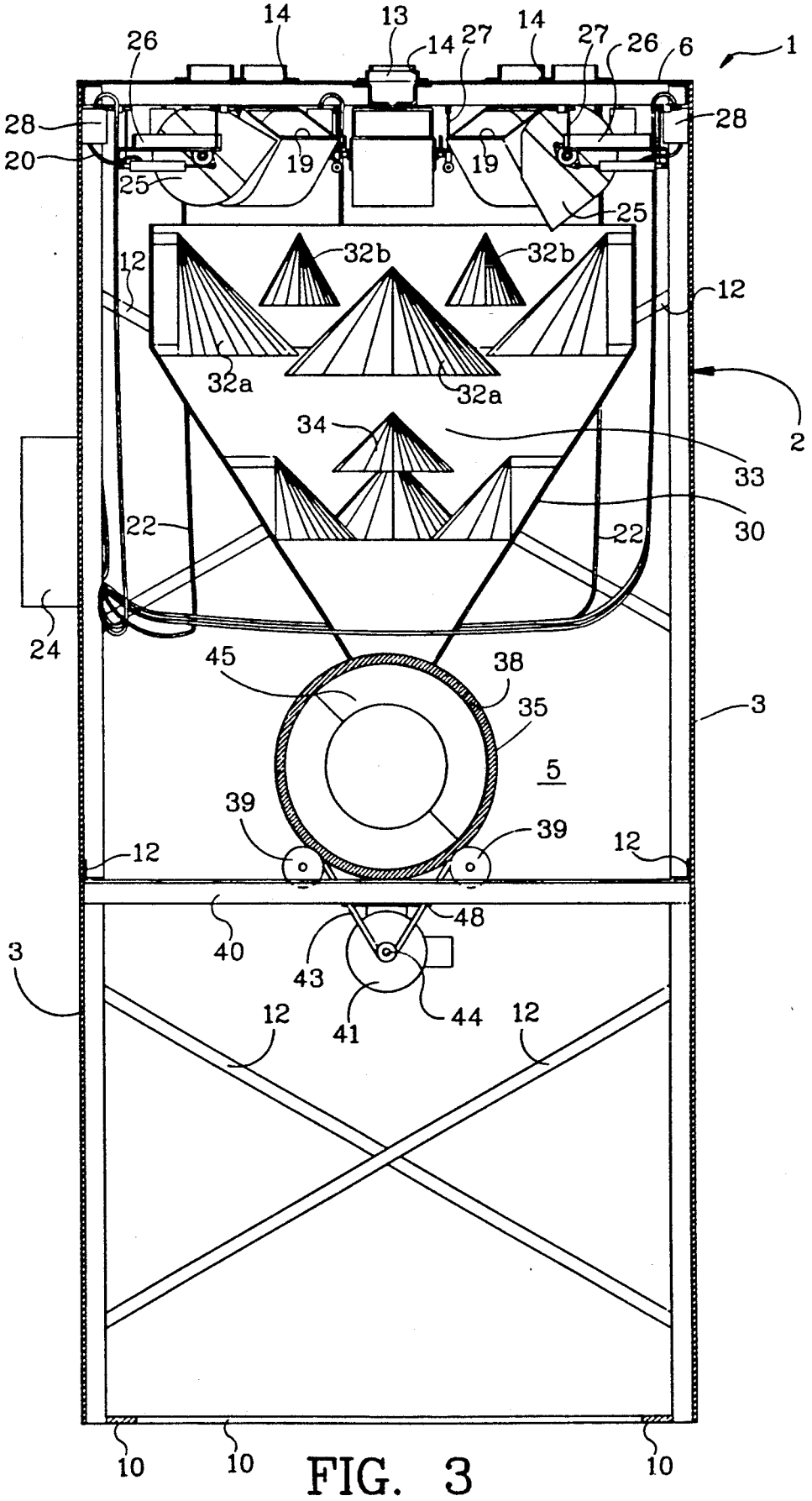
FIG. 3 is an enlarged sectional view taken on line 3—3, FIG. 1.

The weighing and integrating apparatus of the present invention is indicated generally at 1, and is shown generally in FIG. 1 in its intended use with auxiliary metering and packaging equipment, and is shown in greater detail in FIGS. 2-3. Apparatus 1 weighs and integrates different vitamins and minerals into specific nutritional supplement formulations, for subsequent blending or mixing with livestock feed grain.

Apparatus 1 includes a generally rectangular-shaped, relatively compact housing indicated generally at 2. Housing 2 comprises a pair of spaced parallel sidewalls 3, spaced parallel front and rear walls 4 and 5, respectively, and a top wall 6 (FIGS. 1-3). A flange 10 is attached to and extends inwardly from the bottom edge of sidewalls 3 and front and rear walls 4 and 5 for stabilizing and supporting housing 2 when apparatus 1 is in an upright operating position. A plurality of support bars 12 extend between front and rear walls 4 and 5 adjacent to sidewalls 3, and between the sidewalls adjacent to the front and rear walls, to further stabilize, support and strengthen housing 2. A support beam 13 is attached to top wall 6 to still further stabilize and strengthen housing 2. A plurality of inlet openings 14 are formed in top wall 6 in an equally spaced, circular arrangement, and an opening 15 is formed in front wall 4. The preferred number of inlet openings 14 is eight, although more or less than eight inlet openings could be incorporated into apparatus 1 without effecting the concept of the invention. A chute 16 is attached to and extends outwardly of front wall 4 and is aligned with opening 15, and terminates in a downwardly facing outlet opening 17.

A plurality of weigh hoppers 25, each of which is formed with an opening 19, is positioned below and in alignment with a respective one of the housing inlet openings 14 for receiving, weighing and releasing a selected vitamin and/or mineral supplement (FIGS. 2-3). The preferred number of weigh hoppers is eight to match the preferred number of inlet openings 14. Each weigh hopper 25 is pivotally mounted on a set of electronic load cells 26 of a type well-known in the art. Load cells 26 are suspended from top wall 6 of housing 2 by a wire rope assembly 27. A plurality of usual augers 29 are used to move the nutritional supplements from a storage area (not shown) and into hoppers 25. A plurality of electronic weight indicators 28, of the type manufactured by Pennsylvania Scale of Leola, Pa., and identified by the designations Series 3000 and 3000E, are electrically connected to load cells 26 and augers 29 by electrical cables 20 and 21, respectively. Weight indicators 28 are programmable, and control and coordinate weighing by load cells 26, the amount of vitamins and minerals deposited in weigh hoppers 25 by augers 29, and the pivotal dumping movement of the hoppers. In addition, weight indicators 28 are electrically connected to and interfaced with a computer 24, such as a usual personal computer, by electrical cables 22 for enhanced integration, control and automation of the weighing system and to obtain data feedback. However, computer 24 could be eliminated without effecting the concept of the invention.

Figure 6:
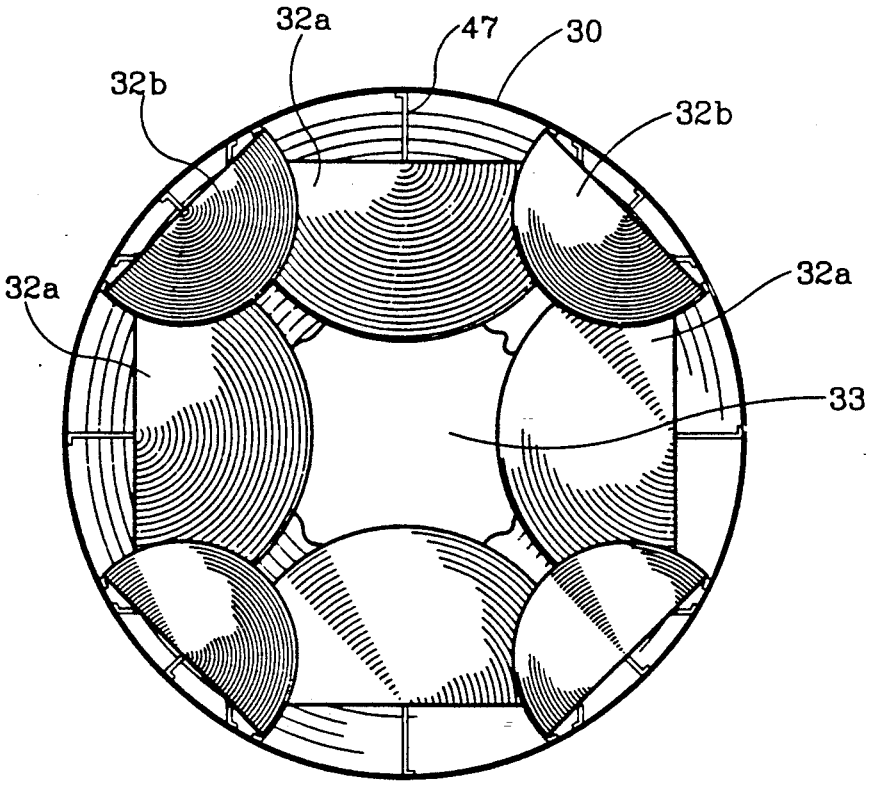
FIG. 6 is an enlarged fragmentary sectional view taken on line 6—6, FIG. 2, particularly showing the first stage of material deflectors.

In accordance with one of the main features of the present invention, a funnel-shaped hopper 30 formed with an inlet opening 23 is mounted within housing 2 below weigh hoppers 25 for receiving, integrating and directing the weighed and released nutritional supplements downwardly and out of a narrow funnel tip 31 (FIG. 2). A first set or stage of semiconical deflectors 32 are attached by a plurality of brackets 47 along the periphery of funnel hopper 30 adjacent to inlet opening 23 (FIG. 6). Each deflector 32 generally is positioned below a respective one of the weigh hoppers 25. Deflectors 32 direct the flow of released nutritional supplement material generally inwardly toward a central area 33 of funnel 30 to begin integrating the material. The first set of deflectors 32 includes large and small deflectors 32*a* and 32*b*, respectively, with the large deflectors 32*a* being positioned below the weigh hoppers 25 which will dump the heavier supplement components for quicker integration thereof.

Figure 7:
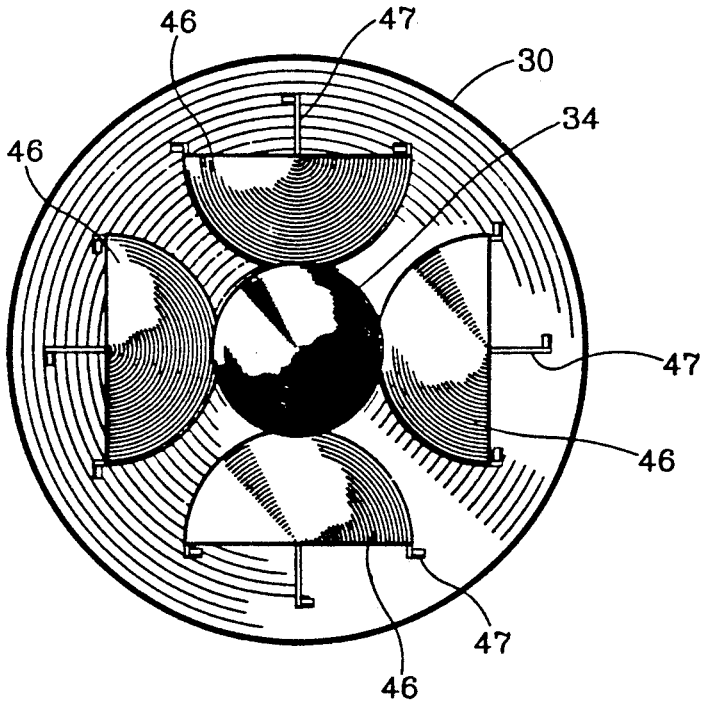
FIG. 7 is an enlarged sectional view taken on line 7—7, FIG. 2, particularly showing the intermediate cone and the second stage of material deflectors.

An intermediate, centrally located cone 34 (FIG. 7) is located below the first set of deflectors 32 and redirects the material from central area 33 outwardly onto a second set or stage of semiconical deflectors 46, which are attached by brackets 47 along the periphery of funnel hopper 30 below and in a spaced relationship to deflectors 32. Deflectors 46 variously direct the flow of material inwardly, and outwardly toward the conical tapered funnel hopper wall to further integrate the material, as described below in the description of the operation of apparatus 1. The generally circular arrangement of the weigh hoppers 25 and deflectors 32 and 46 results in the quick integration of the various supplements.

A drum 35 having first and second open ends 36 and 37 is rotatably mounted between and flowingly connects narrow funnel tip 31 and chute outlet opening 17 (FIGS. 2 and 3). More specifically, narrow funnel tip 31 extends into first open end 36 of drum 35, and second open end 37 of the drum extends into chute 16. A pair of longitudinally spaced, parallel, circumferentially extending tracks 38 are formed on the exterior surface of drum 35 for engaging spaced pairs of rollers 39 mounted on brackets 40. A motor 41 is mounted on a bracket 42 which in turn is mounted on brackets 48. Motor 41 is drivingly connected to drum 35 by an endless drive belt 43 which extends between and operatively engages an output shaft 44 of the motor and a complementary shaped and sized groove (not shown) formed in and extending circumferentially about the drum sidewall. A plurality of flights 45 are attached to the inside surface of drum 35 for further integrating and urging the vitamin and mineral supplements through second open end 37 of the drum and out of chute outlet opening 17. If desired, drum 35 can be equipped with any suitable device which sprays mineral oil into the drum to aid in reducing the spread of dust from the vitamin and mineral material when the supplements pass out of chute outlet opening 17. An external venting device also may be built into housing 2 to further assist in reducing the dust problem. Both the spraying and venting devices are well-known in the art.

A packaging device (FIG. 1), indicated generally at 52, and being of the type manufactured by Express Scale Parts, inc. of Shawnee, Kans., and identified as Model 700, is located adjacent to chute 16 for packaging the weighed and integrated supplement formulation, as described in detail below.

The method of integrating various nutritional supplements for subsequent blending of the formulation with a livestock feed grain includes the following steps. Each auger 29 conveys a certain vitamin and/or mineral or other nutritional supplement from its respective storage bin, through a respective one of the inlet openings 14, and into a respective one of the weigh hoppers 25 through its opening 19. Augers 29 have "fast" and "trickle" speeds which are controlled by electronic weight indicators 28. The fast speed is utilized for filling each weigh hopper 25 with approximately 90% of the desired amount of the nutritional supplement being conveyed into the hopper by its respective auger 29. When the weigh hopper becomes filled with 90% of the desired amount, weight indicator 28 automatically shifts the auger into its trickle speed for filling the weigh hopper with the final 10% of the desired amount of supplement. This ensures that the precise amounts of the vitamins and minerals, as determined by the particular nutritional supplement formula being manufactured, are ultimately integrated so that each package of the formulation is uniform and contains exactly the same proportion of the vitamins and minerals. The weigh hoppers are accurate to within 0.01 pound for achieving such consistency between different packages of the same formulation.

After the automatic and simultaneous metering of the correct desired amounts of the vitamins and minerals into weigh hoppers 25, the weigh hoppers are actuated by weight indicators 28 and automatically pivot on load cells 26 and simultaneously dump the various supplements into inlet opening 23 of funnel hopper 30. After weigh hoppers 25 dump their contents, they automatically pivot to their upright position for refilling. Thus, it can be seen that apparatus provides for continuous weighing and integration of the various supplements of a given formulation, which is efficient and keeps manufacturing costs low, since the fill-weigh-release steps of the method are a time-limiting factor in the manufacturing process.

As the supplements pass downwardly by gravity into funnel hopper 30, they become integrated by the first set of deflectors 32, cone 34, the second set of deflectors 46, and the conical tapered funnel wall, and continue to pass downwardly through the narrow funnel tip 31 of the funnel hopper and into first open end 36 of drum 35. It is important to note that gravity, the various deflectors and cone, and the tapered funnel wall, combine to integrate the supplements, with the result that costly power requirements for apparatus 1 are kept to a minimum, in contrast to many prior art apparatus which have excessive power requirements for rotating large drums containing several tons of supplement. Also, maintenance costs are negligible since moving parts are minimized. The supplements then are further integrated by flights 45 within rotating drum 35 and are urged from second open end 37 of the drum by the flights. The integrated vitamins and minerals then drop from chute outlet opening 17 and into a package or bag 51 which moves along bag closing conveyor 52, for securely closing open end 53 of the bag (FIG. 1).

Figure 4:
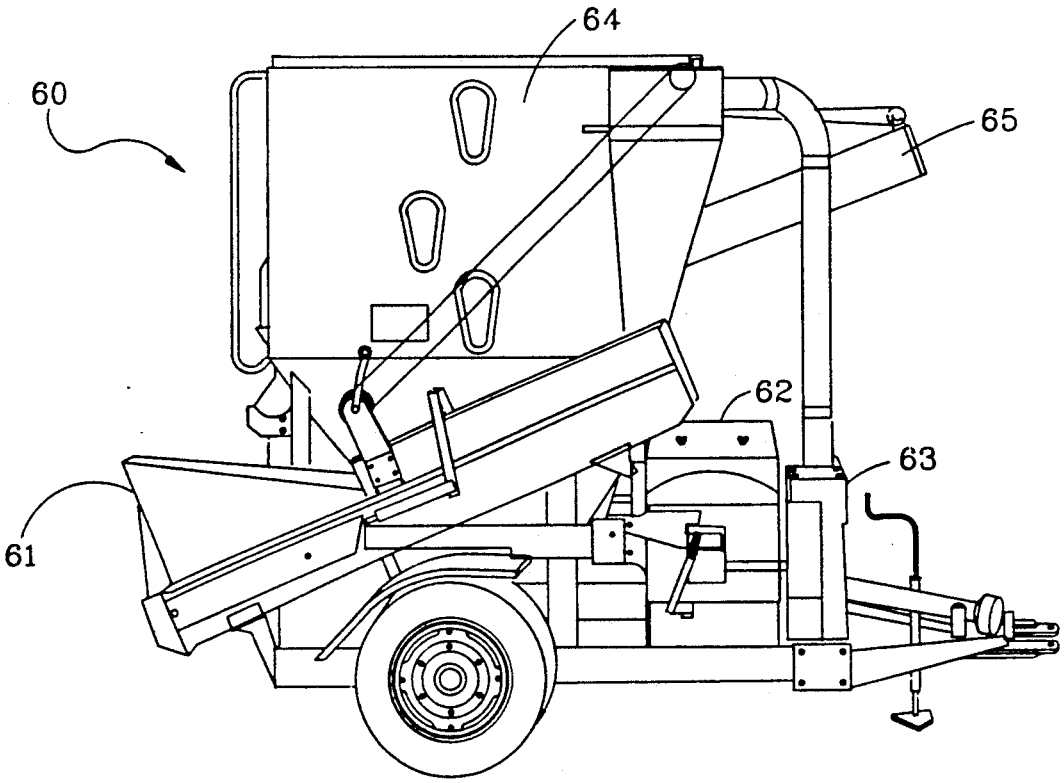
FIG. 4 is a front elevational view of a vertical-type batch blending apparatus.
Figure 5:
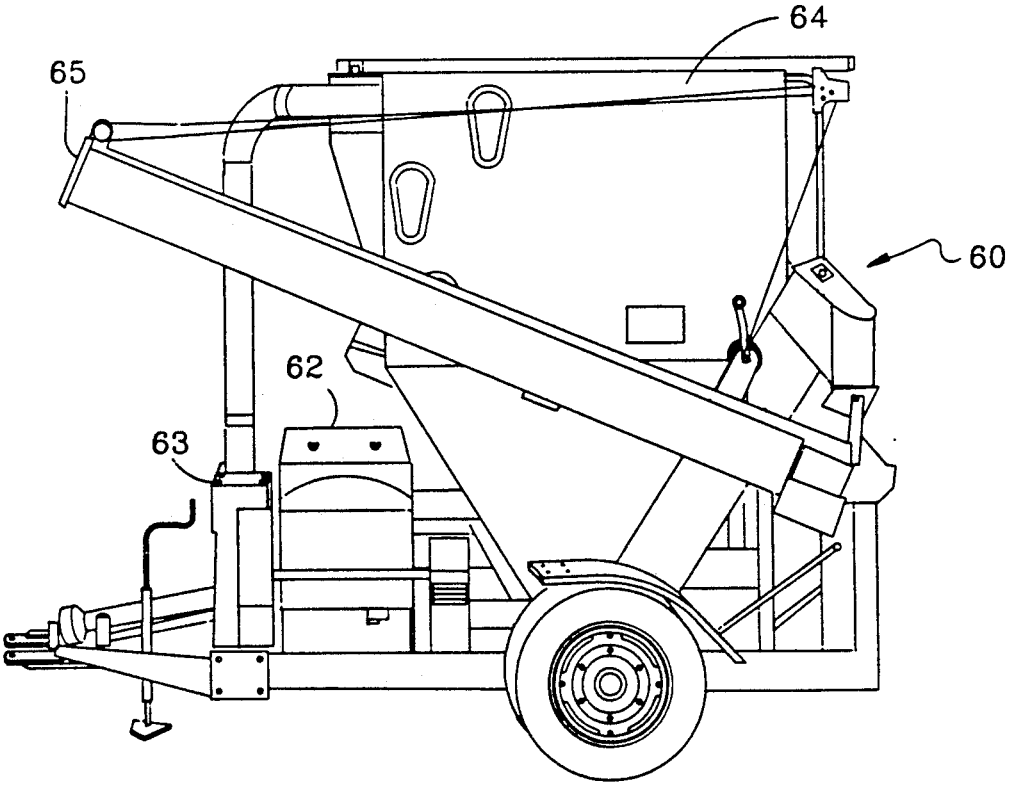
FIG. 5 is a rear elevational view of the batch blending apparatus of FIG. 4.

The packaged nutritional supplement formulation, usually packaged in bags containing 20–100 pounds of the formulation at the rate of approximately 4 bags per minute, then is transported to a feed manufacturing facility or to a farm having a facility on the premises. An appropriate amount of integrated nutritional supplement then is added to a batch blending or mixing apparatus, an example of which is illustrated in FIGS. 4 and 5 and is indicated generally at 60. The main components of blender 60, which is a vertical-type mixer, are a loading auger 61, a hammermill 62, an impeller 63, a mixing hopper 64, and an unloading auger 65. Loading auger 61 conveys feed grain such as corn and beans from a storage bin to hammermill 62, which grinds the whole feed grain into meal. Impeller 63 then conveys the ground meal from hammermill 62 into mixing hopper 64. A vertical mixing auger within hopper 64 rotates and thoroughly mixes or blends the grain meal with the nutritional supplement formulation which was previously added to the hopper. It is to be understood that this mixing or blending by apparatus 60 is more complete than the integration of vitamins and minerals by apparatus 1, which is not a thorough mixing or blending of the supplements. Unloading auger 65 then conveys the final thoroughly mixed feed ingredients from hopper 64 into the livestock feeders.

It is to be understood that apparatus 1 can have greater or less than eight weigh hoppers and corresponding inlet openings, depending on the individual needs of nutritional supplement manufacturers. In addition, other means for conveying the nutritional supplements from their storage bins and into the weigh hoppers can be used other than augers 29, without effecting the concept of the invention. Also, the size, shape, number, location, and/or arrangement of the deflectors and cone can be varied depending on the number of weigh hoppers, materials to be integrated, etc. Moreover, drum 35 and the associated equipment for rotating the drum can be eliminated from apparatus 1, again without effecting the concept of the invention. It should be noted, however, that the inclusion of drum 35 in apparatus 1 does not slow the integration process, but merely utilizes available time in the operation when the weigh hoppers are refilling and weighing. Finally, the apparatus could be used to integrate materials other than livestock feed nutritional supplements.

Again, one of the important features of the present invention is the manner in which apparatus accurately weighs and integrates different nutritional supplements for packaging in individual bags containing exactly the same proportion of vitamins and minerals of a specific supplement formulation for shipment to a feed manufacturer for subsequent blending or mixing with livestock feed grains. In addition, special orders or customized supplement formulations in small amounts can be as inexpensively produced using apparatus 1 as other larger orders for other formulations, since the formulations are rapidly prepared a package at a time instead of in large batches. This package at a time process also keeps costly inventory relatively low. Another important feature of the invention is the manner in which the weigh hoppers and augers are automatically controlled by electronic weight indicators and a computer, providing for continuous weighing, integrating and packaging of a particular nutritional formula so that the apparatus is continuously producing the desired product, with as few as one worker.

In summary, the apparatus of the present invention is relatively inexpensive, compact, durable and easy to maintain and operate and reduces the cost of manufacturing nutritional supplement formulations including customized orders. In addition, the method of the invention is effective, efficient, inexpensive, and requires a minimal number of workers to achieve the desired results.

Accordingly, the method and apparatus for integrating nutritional supplements of the present invention is simplified, provides an effective, safe, inexpensive, and efficient method and apparatus which achieves all the enumerated objectives, provides for eliminating difficulties encountered with prior methods and apparatus, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the method steps and the manner in which the improved apparatus is used and constructed, the characteristics of the method and apparatus, and the advantageous, new and useful results obtained; the new and useful structures, devices, elements, arrangements, parts, and combinations, are set forth in the appended claims.

We claim:

1. An apparatus adapted for automatically and simultaneously weighing and integrating at least two different nutritional supplements for subsequent blending with a livestock feed grain, said apparatus including:

a) a housing formed with at least one inlet opening and an outlet opening located below said inlet opening;

b) weighing means mounted within the housing adjacent to the housing inlet opening for receiving, weighing, and releasing the nutritional supplements, said weighing means including at least a pair of weigh hoppers, each pivotally mounted on an electronic load cell adjacently below and in alignment with the housing inlet opening;

c) metering means for depositing the nutritional supplements into the weighing means through the inlet opening of the housing;

d) means mounted within the housing below the weighing means for integrating and guiding the weighed and released supplements downwardly and out of the housing outlet opening; and e) computer means interfaced with the weighing means and metering means for controlling and coordinating the receipt, weighing and release of the nutritional supplements.

2. The apparatus defined in claim 1 in which the metering means is at least two augers.

3. The apparatus defined in claim 1 in which the housing is upright and generally rectangular-shaped, and comprises a pair of spaced parallel sidewalls, spaced parallel front and rear walls, and a top wall; and in which a plurality of inlet openings are formed in the top wall in an equally spaced, circular arrangement.

4. The apparatus defined in claim 3 in which the weighing means is at least a pair of weigh hoppers each pivotally mounted on a set of electronic load cells adjacently below and in alignment with the housing inlet opening.

5. The apparatus defined in claim 1 in which the means mounted within the housing below the weighing means is a generally funnel-shaped hopper containing a plurality of deflectors.

6. The apparatus defined in claim 5 in which the plurality of deflectors includes an upper set of a plurality of generally semiconical members located in a generally circular arrangement about the periphery of the hopper, an intermediate, centrally located conical member, and a lower set of a plurality of generally semiconical members located in a generally circular arrangement about the periphery of the hopper.

7. The apparatus defined in claim 1 in which means for further integrating the nutritional supplements is mounted in the housing below a funnel-shaped hopper.

8. The apparatus defined in claim 7 in which the means for further integrating the nutritional supplements is a drum rotatably mounted in the housing between and in flowing communication with the funnel-shaped hopper and the outlet opening of the housing; in which a plurality of flights are attached to an interior surface of the drum; and in which the drum is rotatably driven by a motor, so that the integrated nutritional supplements pass downwardly by gravity from the funnel-shaped hopper into the rotating drum and are further integrated, afterwhich said supplements are urged from the drum by the flights and out of the housing outlet opening.

9. The apparatus defined in claim 1 in which means for packaging the integrated nutritional supplements is positioned adjacent to the housing outlet opening.

10. The apparatus defined in claim 1 in which the computer means is a plurality of electronic weight indicators electrically connected to the weighing means and the metering means.

11. The apparatus defined in claim 1 in which the computer means is a computer electrically connected to a plurality of electronic weight indicators, which in turn are electrically connected to the weighing means, metering means, and computer.

12. An apparatus adapted for automatically and simultaneously weighing and integrating a plurality of different supplemental ingredients for subsequent mixing with at least one base ingredient, said apparatus including:

a) a housing formed with at least one inlet opening and an outlet opening located below said inlet opening;

b) weighing means mounted within the housing adjacent to the housing inlet opening for receiving, weighing and releasing the supplemental ingredients, said weighing means including at least a pair of weigh hoppers, each pivotally mounted on an electronic load cell adjacently below and in alignment with the housing inlet opening;

c) metering means for depositing the supplemental ingredients into the weighing means through the inlet opening of the housing;

d) means mounted within the housing below the weighing means for integrating and guiding the weighed and released supplemental ingredients downwardly and out of the housing outlet opening; and e) means electrically connected to the weighing means and metering means for controlling and coordinating the receipt, weighing and release of the supplemental ingredients.

13. An apparatus adapted for automatically and simultaneously weighing and integrating at least two different nutritional supplements for subsequent blending with a livestock feed grain, said apparatus including;

a) a housing formed with at least one inlet opening and an outlet opening located below said inlet opening;

b) weighing means mounted within the housing adjacent to the housing inlet opening for receiving, weighing, and releasing the nutritional supplements;

c) metering means for depositing the nutritional supplements into the weighing means through the inlet opening of the housing;

d) means mounted within the housing below the weighing means for integrating and guiding the weighed and released supplements downwardly and out of the housing outlet opening, said means including a funnel-shaped hopper, a drum rotatably mounted in the housing between and in flowing communication with the funnel-shaped hopper and the outlet opening of the housing, a plurality of flights attached to an interior surface of the drum, a motor for rotatably driving the drum so that the integrated nutritional supplements pass downwardly by gravity from the funnel-shaped hopper into the rotating drum and are further integrated, afterwhich said supplements are urged from the drum by the flights and out of the housing outlet opening; and e) computer means interfaced with the weighing means and metering means for controlling and coordinating the receipt, weighing and release of the nutritional supplements.

14. An apparatus adapted for automatically and simultaneously weighing and integrating at least two different nutritional supplements for subsequent blending with a livestock feed grain, said apparatus including an upright and generally rectangular-shaped housing having a pair of spaced parallel sidewalls, spaced parallel front and rear walls, and a top wall; a plurality of inlet openings formed in the top wall in an equally spaced, circular arrangement; an outlet opening located below said inlet opening; weighing means mounted within the housing adjacent to the housing inlet opening for receiving, weighing, and releasing the nutritional supplements; metering means for depositing the nutritional supplements into the weighing means through the inlet opening of the housing; means mounted within the housing below the weighing means for integrating and guiding the weighed and released supplements downwardly and out of the housing outlet opening; and computer means interfaced with the weighing means and metering means for controlling and coordinating the receipt, weighing and release of the nutritional supplements.

15. An apparatus adapted for automatically and simultaneously weighing and integrating at least two different nutritional supplements for subsequent blending with a livestock feed grain, said apparatus including;

a) a housing formed with at least one inlet opening and an outlet opening located below said inlet opening;

b) weighing means mounted within the housing adjacent to the housing inlet opening for receiving, weighing, and releasing the nutritional supplements;

c) metering means for depositing the nutritional supplements into the weighing means through the inlet opening of the housing;

d) means mounted within the housing below the weighing means for integrating and guiding the weighed and released supplements downwardly and out of the housing outlet opening, said means including a generally funnel-shaped hopper containing an upper set of generally semiconical deflector members located in a generally circular arrangement about the periphery of the hopper and an intermediate, centrally located conical deflector member, and a lower set of generally semiconical deflector members located in a generally circular arrangement about the periphery of the hopper; and e) computer means interfaced with the weighing means and metering means for controlling and coordinating the receipt, weighing and release of the nutritional supplements.

16. An apparatus adapted for automatically and simultaneously weighing and integrating at least two different nutritional supplements for subsequent blending with a livestock feed grain, said apparatus including;

a) a housing formed with at least one inlet opening and an outlet opening located below said inlet opening;

b) weighing means including electronic load cells mounted within the housing adjacent to the housing inlet opening for receiving, weighing, and releasing the nutritional supplements;

c) metering means for depositing the nutritional supplements into the weighing means through the inlet opening of the housing;

d) baffle means mounted within the housing below the weighing means for integrating and guiding the weighed and released supplements downwardly and out of the housing outlet opening; and e) power driven drum means rotatable mounted in the housing beneath the baffle means for receiving the integrated nutritional supplements after passing over the baffle means and for moving said supplements through the drum means to further integrate the supplements before exiting the drum means and out of the housing outlet openings; and f) computer means interfaced with the weighing means and metering means for controlling and coordinating the receipt, weighing and release of the nutritional supplements.

17. The apparatus defined in claim 16 in which the drum means is power driven by a motor.

18. The apparatus defined in claim 16 in which the drum means include a drum containing a plurality of flights attached to the interior surface; and in which the flights further integrate the supplements and urge them toward and out of the housing outlet opening.

* * * * *